United States Patent [19]

Martin

[11] Patent Number: 5,068,989

[45] Date of Patent: Dec. 3, 1991

[54] MEANS FOR REDUCING THE CRIMINAL USEFULNESS OF DISCHARGEABLE HAND WEAPONS

[76] Inventor: John M. Martin, 15 Charing Cross Ct., Brownsville, Tex. 78521

[21] Appl. No.: 551,299

[22] Filed: Jul. 12, 1990

Related U.S. Application Data

[63] Continuation-in-part of Ser. No. 188,646, May 2, 1988, abandoned, which is a continuation-in-part of Ser. No. 880,095, Jun. 10, 1987, abandoned, which is a continuation-in-part of Ser. No. 589,773, Mar. 15, 1984, abandoned.

[51] Int. Cl.[5] ..... F41A 17/00

[52] U.S. Cl. ..... 42/70.01; 42/106

[58] Field of Search ..... 42/70.01, 70.11, 106

[56] References Cited

U.S. PATENT DOCUMENTS

| | | | |
|---|---|---|---|
| 4,256,013 | 3/1981 | Quitadamo | 42/84 |
| 4,563,827 | 1/1986 | Heltzel | 42/84 |
| 4,672,763 | 6/1987 | Cunningham | 42/70.11 |

*Primary Examiner*—Richard W. Wendtland

[57] ABSTRACT

Methods and apparatuses for reducing the criminal usefulness of a dischargeable hand weapon wherein the weapon is temporarily or permanently linked to a relatively heavy, bulky or long object by either a cord, cable, or signal, wherein the weapon may be prevented from discharging immediately after or a certain amount of time after it becomes unlinked from the object and wherein the object must be moved with the weapon when the weapon is taken to a relatively distant location for discharging, thereby effectively reducing the portability and concealability of the weapon for distant locations where it is more likely to be used for a crime.

24 Claims, 4 Drawing Sheets

FIG. 1
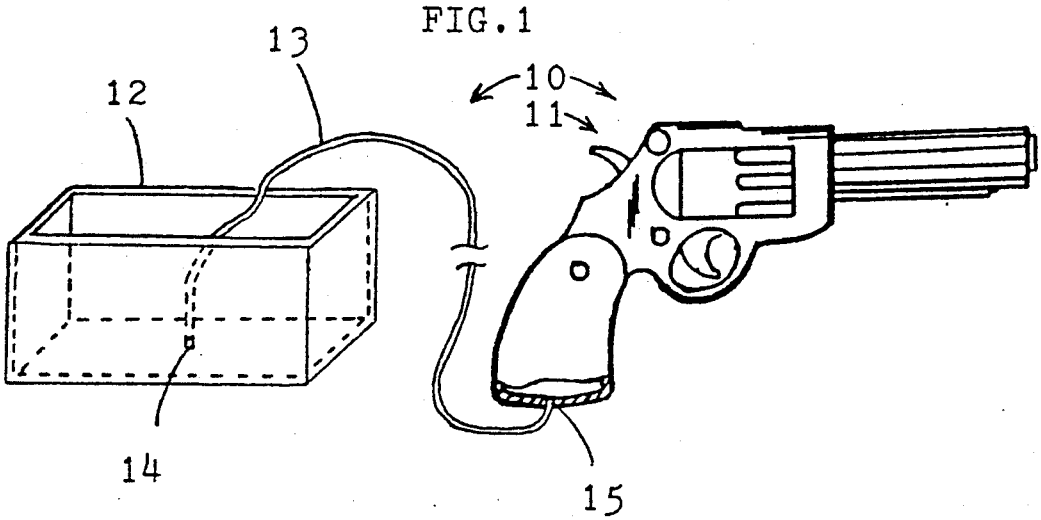
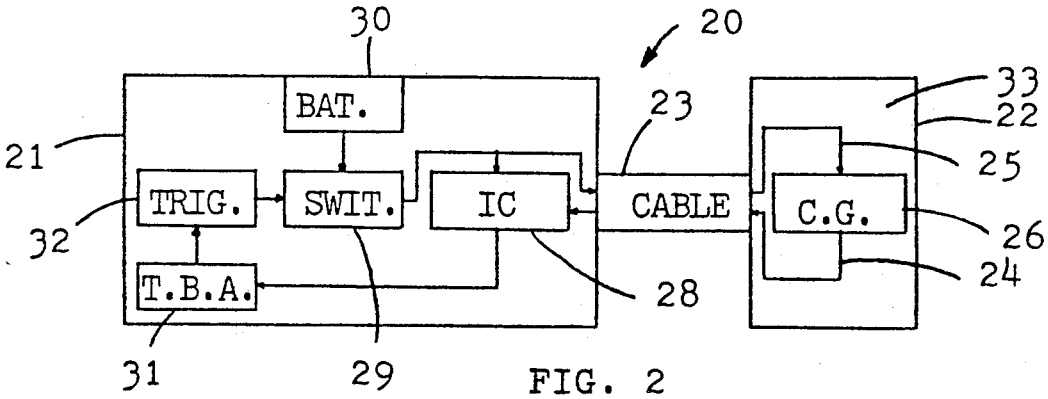
FIG. 2
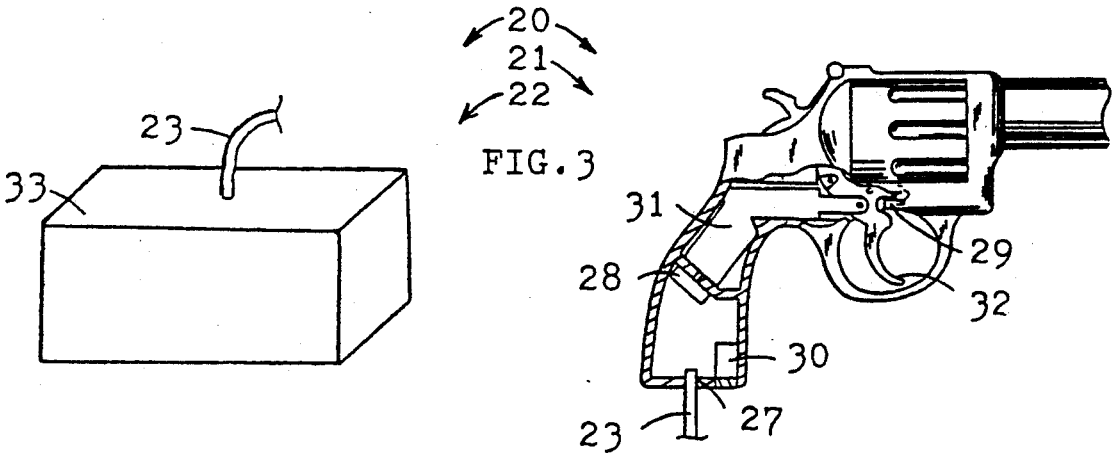
FIG. 3

MEANS FOR REDUCING THE CRIMINAL USEFULNESS OF DISCHARGEABLE HAND WEAPONS

CROSS REFERENCE TO RELATED APPLICATIONS

This application is a continuation-in-part application of application Ser. No. 188,646 filed 5/2/88 and now abandoned which was a continuation-in-part application of application Ser. No. 880,095 filed 6/10/87 and now abandoned which was a continuation-in-part application of application Ser. No. 589,773 filed 3/15/84 and now abandoned.

BACKGROUND OF THE INVENTION

1. Field of the Invention

This invention relates to dischargeable hand weapons and in particular to methods and apparatuses for reducing the criminal usefulness of such weapons.

2. Description of Related Art

Dischargeable hand weapons are popular for defense of persons. Reducing the criminal usefulness of those weapons would save many lives and prevent much crime.

U.S. Pat. Nos. 4,003,152, 4,154,014, 4,256,013, 4,457,091, 4,467,545 and 4,563,827 each disclose means for preventing the discharging of a hand weapon by an unauthorized person.

U.S. Pat. No. 4,256,013 discloses a hand weapon having a hand supported part linked by a nonrigid means to a relatively large part of the weapon that controls the discharging of the weapon. U.S. Pat. No. Des. 242,567 discloses a related form. In addition, gun stores sometimes link guns to other objects with cables or chains in order to prevent theft.

U.S. Pat. Nos. 4,003,152 and 4,488,370 each disclose an apparatus that can link a person to a hand weapon by means of a transmitter and receiver and prevents the discharging of the weapon if there is no linkage.

SUMMARY OF THE INVENTION

There are several ways of reducing the usefulness of a hand weapon for crimes. One way is by reducing the portability and/or concealability of the weapon by linking it to an object having an unwieldy weight, volume or length.

Accordingly, one object of this invention is to provide methods and apparatuses for reducing the portability and concealability of a dischargeable hand weapon for relatively distant locations without greatly affecting its portability and concealability for relatively close locations; more specifically, to provide a method for linking the weapon to an unwieldy object and to provide an apparatus that links the weapon to an unwieldy object and prevents the discharging of the weapon based on the weapon not being linked to the object. Linking can be rigid or nonrigid and the preventing of discharging can be immediate or delayed.

Further objects and advantages of this invention will be apparent for a consideration of the drawings and descriptions herein.

BRIEF DESCRIPTION OF THE DRAWINGS

Drawings are not to scale and some obviously necessary parts may be omitted, e.g. ground wires, or modified in shape in order to allow for clearer illustration of other parts.

FIG. 1 illustrates a handgun with its handle partially cut away and dotted lines illustrating hidden parts.

FIG. 2 is a block diagram of a handgun having electronic parts.

FIG. 3 further illustrates the handgun of FIG. 2.

DETAILED DESCRIPTION

Figure 4:
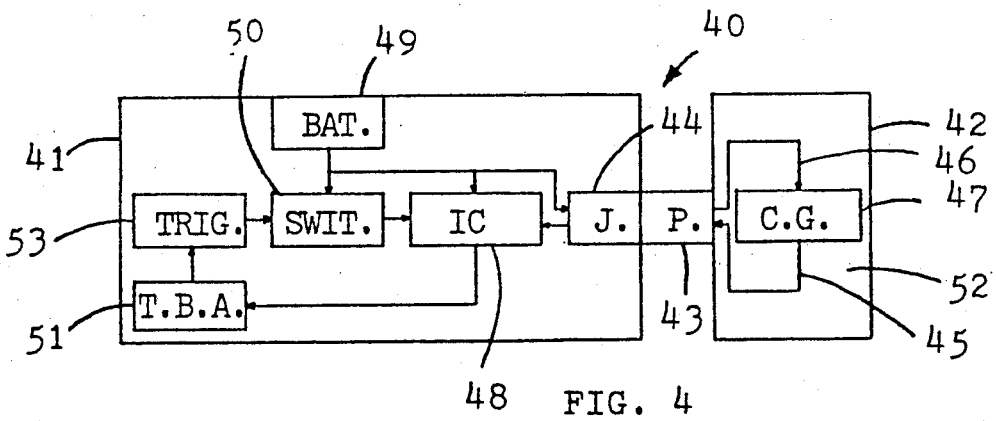
FIG. 4 is a block diagram of a handgun having electronic parts.

In this application *hand weapon* means a weapon which discharges, has a civilian defensive use, is primarily designed for use against living things when used offensively or defensively and is designed to be either partly or totally hand supported during use. Hand weapons include such things as handguns, rifles, shotguns, tear gas sprayers, electric shocking devices and small hand held rocket launchers such as the Gyro-Jet.

In this application *criminal usefulness* of a *hand weapon* refers to the usefulness of a hand weapon for illegal acts where one person willfully threatens or injuries another person with the weapon.

In this application, articles and apparatuses can be used for linking objects together. For example, a jack and a plug can rigidly link one object to another. Cords, cables and chains are examples of nonrigid articles that can nonrigidly link two objects together. This allows one of the objects to undergo a change of position while the other remains stationary. A transmitter and a receiver can also nonrigidly link two objects. This occurs when the receiver, in physical contact with one of the objects, is receiving a signal that is being transmitted by the transmitter which is in physical contact with the other object.

FIG. 1 illustrates a handgun 10 having a revolver part 11, a steel box 12 and a 20 m×0.318 cm braided nylon cord 13 which links the box to the revolver part 11.

The box 12 is an open steel box large enough to hold the revolver part 11. It measures 30 cm×15 cm×15 cm. Its walls are 0.7 cm thick and it weighs 10 kg, whereas the revolver part 11 measures 18 cm×10×4 cm and weighs 1 kg.

In this application *unwieldy object* refers to any inanimate object weighing more than 0.5 kg and/or having a volume of more than 40 cc and/or being incapable of being forced without damage into a shape having a length of less than 25 cm. This means that the box can be classified as an unwieldy object. An unwieldy object can also be nonrigid, e.g., it can be a length of chain weighing 0.6 kg that is continuous with a length of chain that links the unwieldy chain to the weapon.

The cord 13 is permanently joined to the box 12 in the center of the inside bottom of the box 12. The joining method comprises drilling a hole 14 in the box 12, passing the cord 13 through the hole 14 and then pressing the steel surrounding the hole 14 to deform it inward to securely hold the cord 13.

The revolver part 11 is a revolver of conventional design with a hole 15 drilled into the handle. The cord 13 is joined to the revolver part 11 by the same method that it is joined to the box 12.

The handgun 10 is designed for defensive use in homes, businesses and vehicles with the box 12 remaining stationary and the cord 13 allowing portability and concealability of the revolver part 11 within the limits of the cord 13.

The cord 13 cannot be easily removed at either of its ends, however, it can be easily cut to allow the revolver part 11 to be carried to any location without the hindrance of the box 12. Therefore, a hand weapon of this type would be suited for use only in jurisdictions having a law against the cutting of its cord or the possession of the weapon with its cord cut.

Although it is possible to use other weights, sizes, materials, etc., those used with this handgun 10 are good choices. The weight and bulk of the box 12 give the handgun 10 poor portability and concealability for locations requiring the moving of the box 12. However, since most defense with a hand weapon is within a relatively small area, the 20 m cord 13 allows the handgun 10 to be adequate for defense in homes, businesses and vehicles. In such uses, the box 12 can be kept concealed or unconcealed in an out of the way place and the revolver part 11 can be carried or kept in a handy place.

FIGS. 2 and 3 illustrate a handgun 20 having a revolver part 21, a block 22 and a 20 m×0.318 cm electric cable 23 which nonrigidly links the revolver part 21 to the block 22. The block 22 measures 30 cm×15 cm×15 cm and weighs 10 kg, whereas the revolver part 21 measures 18 cm×10 cm×4 cm and weighs 1 kg.

The cable 23 has 3 30 gage (AWG) thinly insulated wires. One of the wires is a signal wire 24 for carrying a signal, one is a power wire 25 for carrying power and one is a ground wire (not illustrated) for both the signal and power. All three of the wires continue past both ends of the cable 23. At the block end of the cable each of the wires randomly winds for 1 m through the block 22 before reaching a code generator 26. The code generator 26 as well as any other code generator described hereinafter can be an IC such as an ICL8038. It is an oscillator that can be set to produce signals up to 300 k Hz.

The revolver part 21 is a revolver of essentially conventional design with a hole 27 drilled in its handle. The cable 23 is permanently joined to the revolver part 21 by passing it through the hole and then pressing the steel surrounding the hole 27 to deform it inward to securely hold the cable. Inside the revolver part 21 the signal wire 24 is connected to an IC 28, the power wire 25 is connected to the IC and a normally off switch 29 and the ground wire is connected to the IC 28, a battery 30, which is accessible for replacement, and a trigger blocking apparatus 31 which can block complete movement of the trigger 32.

The IC 28 has a decoding part and an output power sufficient to drive the trigger blocking apparatus 31. This IC 28 as well 28 as well as the other ICs of this application can be made by a custom IC manufacturer having the capability of making ICs based on functional descriptions such as those contained herein. *Electronic Engineer's Master Catalogue, Electronic Buyer's News Handbook and Directory, IC Master, and Electronic Buyer's Guide* are directories that contain listings of such manufacturers.

The switches of this application are the same as part 17 of U.S. Pat. No. 4,488,370 and the triggers and trigger blocking apparatuses are the same as parts 60 through 70 of that same application.

The block 22 is made of opaque epoxy 33 and the amount of weight and volume contributed to the block 22 by the code generator 26 and wires is negligible. The code generator 26 and wires leading to it are firmly embedded without access in the epoxy 33. This construction makes it almost impossible to significantly reduce to size of the block 22 or to tamper with the electronic parts embedded in it without damaging one or more of the parts. The block was formed by pouring freshly mixed opaque epoxy 33 into a mold with the code generator 26 and wires.

The code generator 26, signal wire 24, and IC 28 are essential parts of a system for determining whether or not the block 22 is linked to the revolver part 21. Although this system uses a wire and electricity for carrying a signal it is also possible to use some other type of system, such as a fiber optic system. It is also possible to place the code generator 26 in the revolver part 21 and route the output of the code generator 26 in a loop from the revolver part 21 to the block 22 and back to the revolver part 21.

In this handgun 20 and in any other handgun described hereinafter having a trigger blocking apparatus, the trigger blocking apparatus and the part of the trigger in contact with the trigger blocking apparatus are enclosed in the revolver part which has been welded shut or the revolver part is provided with a lockable and unlockable part for accessing the apparatus and the apparatus is enclosed in the revolver part behind the lockable and unlockable part. Welding serves as a means for preventing access to the trigger blocking apparatus 31 without causing damage to the weapon. Use of a lockable and unlockable part permits legal repairs and maintenance on the enclosed parts without damage to the weapon in a jurisdiction having a legal restriction on accessibility of the parts.

The handgun 20 is designed for defensive use in homes, businesses and vehicles with the block 22 remaining stationary and the cable 23 allowing portability and concealability of the revolver part 21 within the limits of the cable.

The trigger 32 controls the switch 29 and slightly pulling the trigger 32 for firing closes the switch. This sends power from the battery 30 through the power wire 25 to the IC 28 and to the code generator 26. The power causes the code generator 26 to generate a sine wave signal with a frequency based on a serial number assigned to the handgun 20. The signal is coupled to the IC 28 through the signal wire 24. The decoder circuitry of the IC decodes the signal. Decoding of the signal results in the IC 28 sending power to the trigger blocking apparatus 31.

In this handgun 20 and in any other handgun described hereinafter having a trigger blocking apparatus, the apparatus prevents firing when not receiving power from the IC by blocking complete trigger movement and allows firing when receiving power by not blocking any trigger movement. Thus, in this handgun 20 after the trigger blocking apparatus 31 begins receiving power, firing can be accomplished by a continuation of trigger pull. Because the handgun's electronic processing is very fast, firing of the handgun can be made to feel no different than firing a conventional weapon.

If the cable 23 is cut to unlink the revolver part 21 from the block 22, no signal will be received by the IC 28. Consequently, the IC 28 will not send power to the trigger blocking apparatus 31. With no power going to the trigger blocking apparatus 31, the apparatus 31 will block complete trigger movement and the handgun 20 will not be able to be fired. Also, since no signal will be received by the IC 28 if one of the electronic parts in the block 22 has been damaged or if the battery 30 is weak or missing, the handgun will not be able to be fired under those conditions either.

Figure 2A:
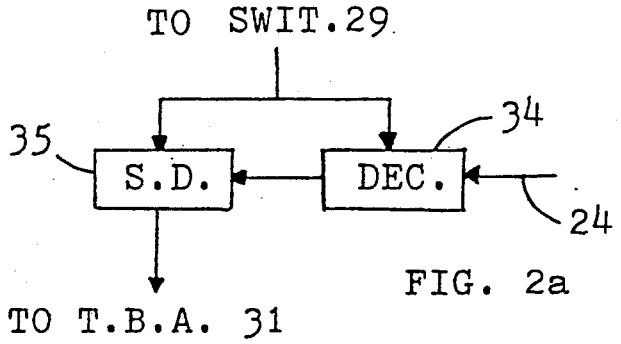
FIG. 2*a* illustrates an alternative to a part of the handgun of FIG. 2.

FIG. 2*a* illustrates a circuit that can be used as an alternative to the IC 28 of FIG. 2. It consists of a decoder 34, and a solenoid driver 35. The power supply to both the decoder 34 and the driver 35 is connected to the switch 29. The input to the decoder 34 is connected to the signal wire 24. The output of the solenoid driver 35 is connected to the solenoid part of the trigger blocking apparatus 31. The decoder 34 and any other decoder described hereinafter can be an IC decoder, e.g. a 567 IC tone decoder will decode frequencies up to 500 k Hz. The driver 35 and any other driver described hereinafter can be a solid state device such as a transistor or a mechanical device such as a SPST reed relay in parallel with a reversed biased diode for protection against inductive voltage spikes. Closing the switch for firing turns on the code generator 26 and decoder 34. The decoder 34 decodes any signal sent to it from the code generator 26. This turns on the solenoid driver 35 which energizes the solenoid part of the trigger blocking 34 apparatus to allow firing.

It is important that the handgun 20 has good resistance to tampering and circumvention. Such resistance is provided by welding shut the revolver part or providing it with a lockable access part, by the small diameter of the wires which makes them easy to cut or break and difficult to splice, by embedding and winding the wires in the epoxy 33 which makes it difficult to cut into the epoxy without cutting at least one wire, by the use of a code system instead of a fairly nonspecific direct current which is easily obtained with batteries and by the use of a trigger blocking apparatus 31 that prevents firing if it does not receive power instead of one that prevents firing if it receives power which can be easily circumvented by removing the battery. In all of the other hand weapons described hereinafter having similar parts there is also the same resistance to tampering and circumvention offered by those parts.

All of the electronic parts of the handgun 20 and the mechanical parts of the trigger blocking apparatus 31 can be regarded as an apparatus for reducing the criminal usefulness of a hand weapon (in this case, the handgun formed by the remaining parts of the revolver part 21) comprising a means for linking the weapon to a certain unwieldy object (epoxy 33) and a means for preventing the discharging of the weapon based on the weapon not being linked to the object at that time.

In this application *based on*, when referring to discharging, refers to a basic condition for preventing discharging. A basic condition can be expressed in other ways which essentially mean the same thing, e.g., in the case of this handgun 20, it could be stated that firing is not prevented or is allowed or enabled based on electrical continuity of the cable. In addition, variations in the actual prevention of firing are within the scope of the basic condition for preventing discharging, e.g. there could be a delay before discharging is prevented.

Although it is possible to use other weights, sizes, materials, systems, etc., those used with this handgun 20 are good choices. The weight and bulk of the block 22 give the handgun poor portability and concealability for locations requiring the moving of the block 22. However, since most defense with a hand weapon is within a relatively small area, the 20 m cable 23 allows the handgun 20 to be adequate for defense in homes, businesses and vehicles. In such uses, the block 22 can be kept concealed or unconcealed in an out of the way place and the revolver part 21 can be carried or kept in a handy place.

Figure 5:
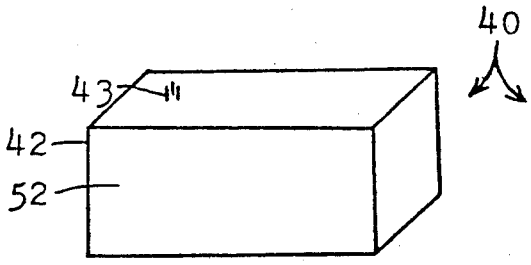
FIG. 5 further illustrates the handgun of FIG. 4.

FIGS. 4 and 5 illustrate a handgun 40 having a revolver part 41, a block 42 and a three prong plug 43 and a jack 44 for linking and unlinking the block 42 and the revolver part 41.

The plug 43 projects from the block 42 and the jack 44 is built into the revolver part 41 so that when the revolver part 41 is linked to the block 42, it will lie on its side on the block 42. The plug 43 and jack 44 can electrically link or unlink 3 30 gage (AWG) thinly insulated wires in the revolver part 41 to like wires embedded in the block 42. One of the wires is a signal wire 45 for carrying a signal, one is a power wire 46 for carrying power and one is a ground wire (not shown) for both the signal and power. Each of the wires in the block 42 randomly wind for 1 m through the block 42 before reaching a code generator 47.

In the revolver part 41, the signal wire 45 is connected to an IC 48, the power wire 46 is connected to a battery 49 which is accessible for replacement, a normally off switch 50 and the IC 48 and the ground wire is connected to the battery 49, the IC 48, and a trigger blocking apparatus 51.

The block 42 is made of opaque epoxy 52 and the amount of weight and volume contributed to the block 42 by the code generator 47 and wires is negligible. The code generator 47 and wires leading to it are firmly embedded without access in the epoxy. This construction makes it almost impossible to significantly reduce to size of the block 42 or to tamper with the electronic parts embedded in it without damaging one or more of the parts. The block 42 was formed by pouring freshly mixed opaque epoxy into a mold with the code generator 47 and wires.

The code generator 47, signal wire 45, and IC 48 are essential parts of a system for determining whether or not the revolver part 41 was linked to the block 42 at any time during the immediately preceding 10 minute period. The IC 48 has a decoding part, a timing part and an output power sufficient to drive the trigger blocking apparatus 51.

The handgun 40 is designed for defensive use in homes, businesses and vehicles with the block 42 remaining stationary and the revolver part 41 having 10 minutes of fireability after being unlinked from the block 42. Except for the electronic parts and the mechanical parts of the trigger blocking apparatus 51, the revolver part 41 is essentially a revolver of conventional design.

When not being used, the revolver part 41 can be linked to block 42 by means of the plug 43 and jack 44. This allows power to be sent from the battery 49 to the code generator 47 through the power wire 46, jack 44 and plug 43. The power causes the code generator 47 to generate a sine wave signal with a frequency based on a serial number assigned to the handgun 40. The signal is coupled to the IC 48 for decoding through the signal wire 45, plug 43 and jack 44.

To use the handgun 40, the revolver part 41 is unlinked from the block 42 and carried to the location where it is to be fired. The switch 50 is controlled by the trigger 53 and slightly pulling the trigger 53 for firing closes the switch 50. This sends power to an input on the IC 48 and if the revolver part 41 was linked to the bock 42 at any time during the immediately preceding 10 minute period, the IC 48 will send power to the trigger blocking apparatus 51.

If the revolver part 41 was not linked to the block 42 at any time during the immediately preceding 10 minute period, the IC 48 will not send power to the trigger blocking apparatus 51. With no power going to the trigger blocking apparatus, the apparatus 51 will block complete trigger movement and the handgun 40 will not be able to be fired.

Thus, in order for this handgun 40 to be fired, its revolver part 41 must have been linked to its block 42 during the immediately preceding 10 minute period. In addition, since no signal will be received by the IC 48 if one of the electronic parts in the block 42 has been damaged or if the battery 49 is weak or missing, the handgun 40 will not be able to be fired under those conditions either.

Figure 4A:
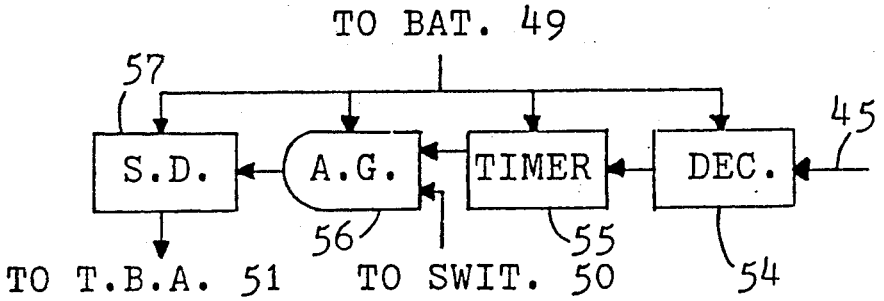
FIG. 4*a* illustrates an alternative to a part of the handgun of FIG. 4.

FIG. 4*a* illustrates a circuit that can be used as an alternative to the IC 48 of FIG. 4. It consists of a decoder 54, a 10 minute timer 55, and AND gate 56 and a solenoid driver 57. The power inputs of all of the parts are connected to the battery 49. The decoder 54 is connected to the signal wire 45. One input of the AND gate 56 is connected to the switch 50 and the other to the timer 55 output. The output of the solenoid driver 57 goes to the solenoid part of the trigger blocking apparatus 51. The timer can be an IC timer/counter having a logic 1 output during timing and the capability of being triggered and retriggered by the output of the decoder 54 and of being set to provide a 10 minute period. When the decoder 54 decodes the signal generated by the code generator 47, its output triggers the timer 55 and continues to retrigger it as long as it decodes the signal. When the switch 50 is pulled during timing, both AND gate inputs and the output are at the 1 level. This turns on the solenoid driver 57 which energizes the solenoid part of the trigger blocking apparatus 51 to allow firing.

All of the electronic parts of the handgun 40 and the mechanical parts of the trigger blocking apparatus 51 can be regarded as an apparatus for reducing the criminal usefulness of a hand weapon (in this case the handgun formed by the remaining parts of the revolver part 41) comprising a means for linking and unlinking the weapon to a certain unwieldy object (epoxy 52) and a means for preventing the discharging of the weapon based on the weapon not being linked to the object during a past certain period.

Although other weights, sizes, materials, times, etc., may be used, those used for this handgun 40 are good choices. The weight and bulk of the block 42 give the handgun poor portability and concealability for locations requiring the moving of the block 42. It makes the handgun 40 useless for constant illegal carrying as a concealed weapon and for crimes lasting more than 10 minutes while allowing the handgun 40 to be adequate for defense in homes, businesses and vehicles.

Since most defense with hand weapons requires less than 10 minutes and a person can momentarily link the revolver part 41 and block 42 or use a backup weapon if more time is needed, there is no great disadvantage to the 10 minute limit. In addition, it is possible to use an electric cord having a jack and plug to link the jack 44 and plug 43 and therefore the handgun 40 and the block 42. This will allow unlimited firing in an area determined by the length of the cord while not making the handgun 40 useful for crimes requiring concealed carrying of the weapon.

Figure 7:
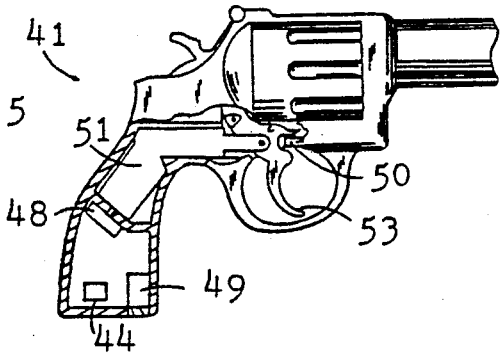
FIG. 7 further illustrates the handgun of FIG. 6.
Figure 7:
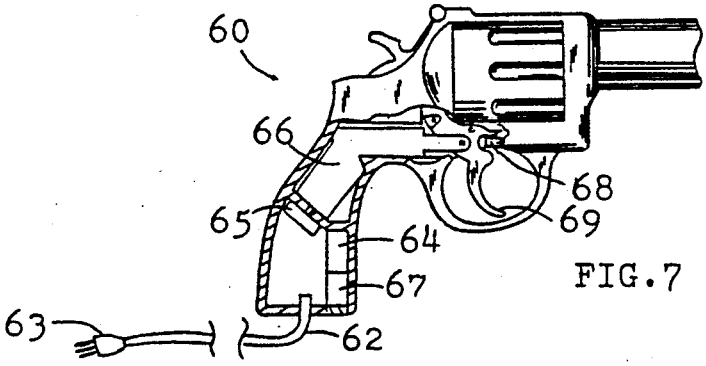
Figure 6:
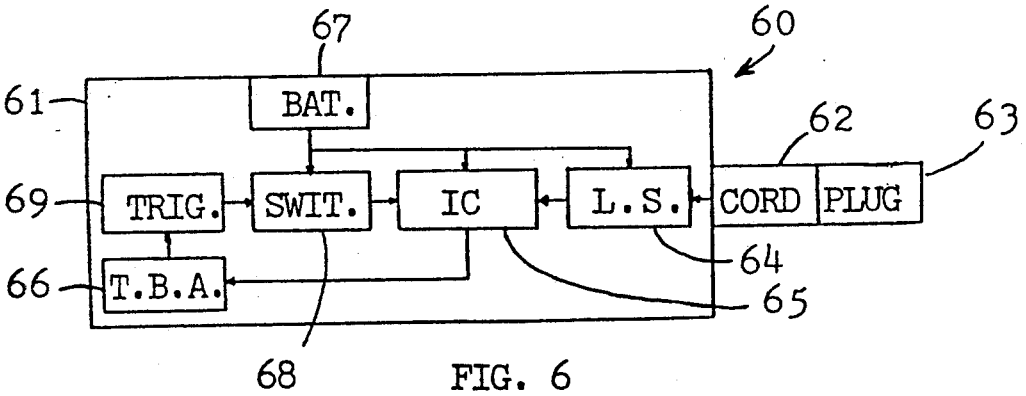
FIG. 6 is a block diagram of a handgun having electronic parts.

FIGS. 6 and 7 illustrate a handgun 60 having revolver part 61 and a 20 m electric cored 62 with a three prong plug 63 at one end and a linking sensor 64 at the other. The plug fits into standard 120 volt 15 and 20 amp grounded outlets. It can be electrically connected to and disconnected from the electrical power and ground existing at those outlets, thereby linking and unlinking the revolver part 61 and an unwieldy object which in this case is a live wiring system, e.g. in a house.

The linking sensor 64 and an IC 65 are essential parts of a system for determining if the revolver part 61 has been linked to a live wiring system during the entire immediately preceding 24 hour period. The linking sensor, located in the revolver part 61, can be a sensor for sensing 110–130 volts ac, a grounded outlet analyzer which senses liveness and grounding or a frequency decoder such as a 567 IC tone decoder (in series with an appropriate resistor) set to decode a 60 Hz signal. The sensor output goes to the IC 65. The IC 65 has timing and other circuitry and its output goes to a trigger blocking apparatus 66. A battery 67 supplies power to the sensor 64 (if needed), IC 65 and a normally off switch 68 which is controlled by the trigger 69.

The handgun 60 is designed for defensive use in homes and businesses with the cord 62 allowing relatively good portability and concealability of the revolver part 61 within the limits of the cord 62. Except for the electronic parts and the mechanical parts of the trigger blocking apparatus 66, the revolver part 61 is essentially a revolver of conventional design.

After being plugged into an outlet for at least 24 hours, the handgun 60 can be fired. Slightly pulling the trigger 69 for firing closes the switch 68. This sends power to an input on the IC 65 and causes the IC 65 to send power to the trigger blocking apparatus 66 if the revolver part 61 has been linked to a live wiring system during the entire immediately preceding 24 hour period. This allows firing. If the revolver part 61 has not been linked to a live wiring system during the entire immediately preceding 24 hour period, no power will be sent to the trigger blocking apparatus 66 and the apparatus will prevent the firing of the handgun 60.

Thus, in order for the handgun 60 to be fired, it must undergo a period of at least 24 hours during which it must remain linked to a live wiring system and it must still be linked when the trigger 69 is pulled. In addition, since all of the electronic parts depend on adequate battery power for operation, the handgun cannot be fired unless it has had a good battery 67 in it for at least 24 hours.

Figure 6A:
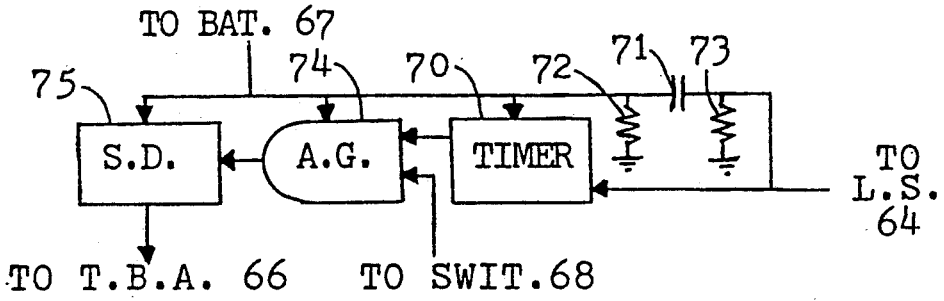
FIG. 6*a* illustrates an alternative to a part of the handgun of FIG. 6.
Figure 8:
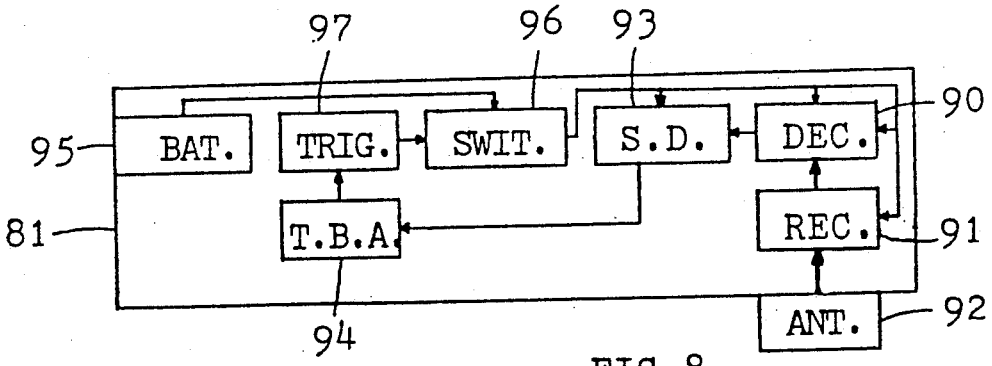
FIG. 8 is a block diagram of a part of a handgun having electronic parts.
Figure 8A:
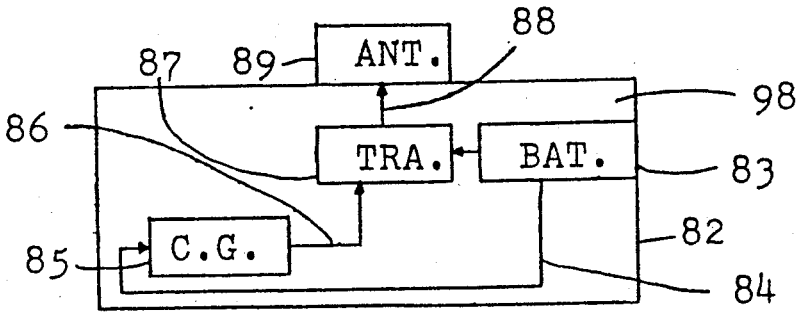
FIG. 8*a* is a block diagram of the rest of the handgun of FIG. 8.
Figure 9:
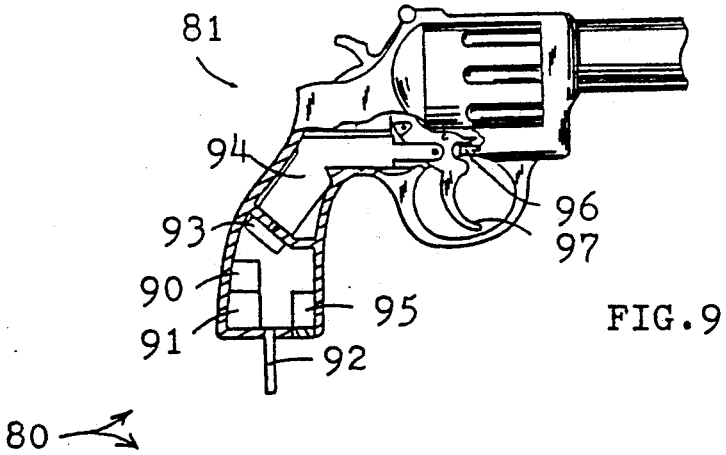
FIG. 9 further illustrates the parts of FIG. 8.
Figure 9A:
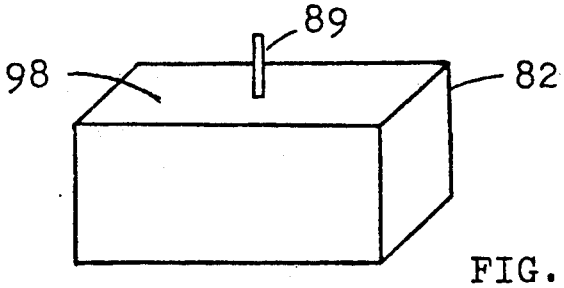
FIG. 9*a* further illustrates the parts of FIG. 8*a*.

FIG. 6*a* illustrates a circuit that can be used as an alternative to the to the IC 65. It is based on a linking sensor that has a logic 1 level output when the handgun 60 is not linked to a live wiring system. It consists of a 24 hour timer 70, a capacitor 71, two resistors 72 and 73, a two input AND gate 74 and a solenoid driver 75. The timer's trigger is connected to the linking sensor 64 and to an RC network consisting of the capacitor 71 and the resistors 72, 73 which are grounded. One of the gate's inputs is connected to the switch 68 and its other input is connected to the output of the timer 70. The output of the solenoid driver 75 is connected to the solenoid part of the trigger blocking apparatus 66. The timer 70 can be an IC timer/counter that has the capability of a logic 0 level output during timing, of being set to provide a 24 hour period and of being triggered and retriggered by a 1 level. The RC network has a capacitance which permits triggering by the battery 67 and linking sensor 64 and resistances which discharge the capacitor 71 quickly enough for the timer 70 to be triggered in the event that the battery 67 is connected, disconnected and then quickly reconnected. The timer 70 is triggered through the capacitor 71 when the battery 67 is connected and retriggering by the battery 67 is prevented by the same capacitor 71. Battery triggering prevents firing of the handgun 60 until the battery 67 has been connected for at least 24 hours. After a 24 hour period of being linked to a live wiring system, the output of the timer 70 goes to the 1 level. Then when the switch 68 is closed, there will be 1 levels on both inputs and the output of the AND gate 74 which will turn on the solenoid driver 75. Turning on the solenoid driver 75 energizes the solenoid part of the trigger blocking apparatus 66 which allows firing.

The electronic parts of the handgun 60 together with the mechanical parts of the trigger blocking apparatus 66 can be regarded as an apparatus for reducing the criminal usefulness of a hand weapon (in this case the handgun formed by the remaining parts of the handgun 60) comprising a means for linking the weapon to a certain unwieldy object, (a live wiring system) and a means for preventing the discharging of the weapon based on the weapon not being linked to the object for a certain amount of time during a past certain period.

Many variations of the handgun 60 are possible. It could be made so that it could still be fired for a certain period of time after removing the plug 63 from a outlet if it became necessary to do so during use. Or a a code signal could be periodically sent over utility lines and the handgun could have a decoder for its linking sensor 64.

Although it is possible to use other lengths, times, systems, etc., those used with this handgun 60 are good choices. They make this handgun useless for many crimes. However, the handgun's usability inside of a relatively small area is not greatly different than that of a conventional handgun. The 20 m of relatively good portability provided by the cord 62 makes it adequate for defense in homes and businesses. Since most hand weapons used for defense in homes and businesses remain in the same location for long periods until they are needed, the 24 hour requirement of this handgun is not a great disadvantage for the average user. In addition, it is possible to use an extension cord with this handgun 60 to allow firing of the handgun in a larger area while not appreciably increasing its criminal usefulness. The larger area could be advantageous for large homes or business buildings.

FIGS. 8, 8*a*, 9 and 9*a* illustrate a handgun 80 having revolver part 81, a base station 82. The base station 82 measures 30 cm×15 cm×15 cm and weighs 10 kg, whereas the revolver part 21 measures 18 cm×10 cm×4 cm and weighs 1 kg.

Illustrated in the base station 82 is a base station battery 83, a 1 m 30 gage (AWG) power supply wire 84, a code generator 85, a 1 m 30 gage signal wire 86, a transmitter 87, a 1 m 30 gage transmission wire 88, and a transmitting antenna 89.

Illustrated in the revolver part 81 is a decoder 90, a receiver 91, an antenna 92, a solenoid driver 93, a trigger blocking apparatus 94, a revolver part battery 95 which is accessible for replacement, a normally off switch 96 and a trigger 97.

The base station 82 is made of opaque epoxy 98 and the wires run randomly through it. The amount of weight and volume contributed to the base station 82 by the battery 83, code generator 85, transmitter 87, transmitting antenna 89, and wires is negligible. The battery 83 is accessible for replacement, however the code generator 85, transmitter 87 and wires are firmly embedded without access in the epoxy 98. This construction makes it almost impossible to significantly reduce to size of the base station 82 or to tamper with the electronic parts embedded in it without damaging one or more of the parts. The base station 82 was formed by pouring freshly mixed opaque epoxy into a mold with the code generator 85 and wires.

The handgun 80 is designed for defensive use in homes, businesses and vehicles with the base station 82 remaining stationary and the revolver part 81 carried and used within about 30 m of the base station 82. Except for the electronic parts and the mechanical parts of the trigger blocking apparatus 94, the revolver part 81 is essentially a revolver of conventional design.

The code generator 85, transmitter 87, antennas, decoder 90 and associated wiring are essential parts of a system for determining whether or not the revolver part 81 is linked to the base station 82.

Power in the base station 82 is supplied to the code generator 85 and transmitter 87 when the base station battery 83 is connected. This causes the code generator 85 to generate a signal consisting of a sine wave with a frequency based on a serial number assigned to the handgun 80. This signal is sent to the transmitter 87 which transmits it by way of the transmission wire 88 and antenna 89.

Power in the handgun part 81 is supplied to the receiver 91, decoder 90 and solenoid driver 93 by the revolver part battery 95 via the switch when the trigger 97 is slightly pulled for firing. The receiver 91 is tuned the same frequency as the transmitter 87 and has a sensitivity such that it cannot receive the signal unless it is within about 30 m of the base station 82. Thus, being within about 30 m of the base station 82 is necessary for linking the revolver part 81 to the base station 82. If the receiver 91 receives the signal, it demodulates it and sends it to the decoder 90 which decodes it. Decoding turns on the solenoid driver 93 which energizes the solenoid part of the trigger blocking apparatus 94 which allows firing.

If the receiver 91 does not receive the signal, no power is sent to the trigger blocking apparatus 94 and the handgun 80 cannot be fired. Thus, in order for the handgun 80 to be fired, its revolver part 81 must be within about 30 m of its base station 82.

The electronic parts of the handgun 80 together with the mechanical parts of the trigger blocking apparatus 94 can be regarded as an apparatus for reducing the criminal usefulness of a hand weapon (in this case the handgun formed by the remaining parts of the handgun 80) comprising a means for linking the weapon to a certain unwieldy object, (epoxy) and a means for preventing the discharging of the weapon based on the weapon not being linked to the object at that time.

Many variations of the handgun 80 are possible, e.g., the signals could be sound or infrared instead of radio, reception distance could be 40 m, the power to the base station 82 could be supplied by a 120 volt ac grounded outlet and the live grounded wiring system could also serve as an unwieldy object, there could be a time requirement for the 120 volt system to be plugged in, there could be a coded signal sent out over the 120 volt power system which would have to be decoded in order for discharging to occur, the transmitter 87 could remain off until a receiver on the base station received a signal transmitted by a transmitter on the revolver part when the trigger 97 is pulled, this system would avoid disclosing the presence of the handgun which might be helpful information to a criminal, etc.

Although other signals, distances, time requirements are possible, those used with this handgun 80 are good choices. They make this handgun useless for many crimes, however, the handgun's usability inside of a relatively small area is not greatly different than that of a conventional handgun. The 30 m of relatively good portability makes it adequate for defense in homes and businesses. Since most hand weapons used for defense in homes and businesses remain in the same location for long periods until they are needed, the 24 hour requirement of this handgun is not a great disadvantage for the average user. In addition, it is possible to use an extension cord with this handgun 80 to allow firing of the handgun 80 in a larger area while not appreciably increasing its criminal usefulness. The larger area could be advantageous for use in large homes or business buildings.

While the above description contains many specificities these should not be construed as limitations on the scope of the invention, but rather as exemplifications of the preferred embodiments thereof. Many variations are possible without departing from the scope of the invention as defined in the appended claims and their legal equivalents.

What is claimed is:

1. A method for reducing the usefulness of a dischargeable hand weapon for many crimes where said usefulness is reduced by reducing the usefulness of said weapon for locations relatively distant to said weapon compared to locations relatively close to said weapon, i.e., the intentional concealed carrying of said weapon, the intentional use of said weapon to intimidate a person and the intentional use of said weapon to cause bodily injury to a person, comprising:

linking said weapon to an unwieldy, inanimate object which will hinder said crimes in cases where said object has to be moved along with said weapon in order to commit said crimes; and allowing said weapon to be moved independently of said object to a location at least 25 cm from said object and discharged.

2. The method of claim 1 wherein said linking comprises linking said weapon to an object weighing more than 0.5 kg.

3. The method of claim 1 wherein said linking comprises linking said weapon to an object having a volume of more than 40 cc.

4. The method of claim 1 wherein said linking comprises linking said weapon to an object incapable of being forced, without damage, into a shape having a length of less than 25 cm.

5. The method of claim 1 wherein said linking comprises linking said weapon to the wiring of a building.

6. The method of claim 1 wherein said linking allows the normal discharging of said weapon when nothing flows, including a signal, between said object and said weapon.

7. The method of claim 1 further comprising:

allowing the discharging of said weapon only when said weapon is linked to said object.

8. The method of claim 7 further comprising:

preventing the discharging of said weapon based on said weapon being unlinked from said object by employing an automatic apparatus requiring no human control for said preventing; and sealing inside said weapon a part of said apparatus subject to circumvention so that said part cannot be accessed without causing damage to the resulting assembly.

9. The method of claim 7 further comprising:

preventing the discharging of said weapon based on said weapon being unlinked from said object by employing an automatic apparatus requiring no human control for said preventing;

placing a part of said apparatus subject to circumvention into a chamber in the resulting assembly having no access except for a lockable and unlockable part; and locking said part of said apparatus inside said chamber.

10. The method of claim 7 further comprising:

using the reception of a coded signal to determine that said weapon is linked to said object and thereby allowing discharging.

11. The method of claim 1 wherein said allowing comprises allowing the unlinking of said weapon from said object and wherein said method further comprises:

preventing the discharging of said weapon based on said weapon not being linked to said object during a past certain period.

12. The method of claim 1 further comprising:

preventing the discharging of said weapon until said weapon has been linked to said object for a certain amount of time.

13. An apparatus comprising:

means for linking a dischargeable hand weapon to a certain unwieldy object;

code generating and decoding means for determining whether or not said object is linked to said weapon, connected to said linking means; and means, connected to said code generating and decoding means, for preventing the discharging of said weapon based on a determination, by said code generating and decoding means, of said weapon not being linked to said object.

14. The apparatus of claim 13 wherein said object is an inanimate object weighing more than 0.5 kg.

15. The apparatus of claim 13 wherein said object is the wiring of a building.

16. The apparatus of claim 13 wherein said preventing means is for preventing the discharging of said weapon based on said weapon not being linked to said object at that time.

17. The apparatus of claim 13 wherein said linking means is also for unlinking said weapon from said object and wherein said preventing means is for preventing the discharging of said weapon based on said weapon not being linked to said object during a past certain period.

18. The apparatus of claim 13 wherein said preventing means is for preventing the discharging of said weapon based on said weapon not being linked to said object for a certain amount of time.

19. An apparatus comprising:

a dischargeable hand weapon;

means for linking said hand weapon to a certain unwieldy object; and means for preventing the discharging of said weapon based on said weapon not being linked to said object, connected to and enclosed in said weapon in such a way that said preventing means cannot be accessed without causing damage to a part of said weapon.

20. The apparatus of claim 19 wherein said object is an inanimate object weighing more than 0.5 kg.

21. The apparatus of claim 19 wherein said object is the wiring of a building.

22. The apparatus of claim 19 wherein said preventing means is for preventing the discharging of said weapon based on said weapon not being linked to said object at that time.

23. The apparatus of claim 19 wherein said linking means is also for unlinking said weapon from said object and wherein said preventing means is for preventing the discharging of said weapon based on said weapon not being linked to said object during a past certain period.

24. The apparatus of claim 19 wherein said preventing means is for preventing the discharging of said weapon based on said weapon not being linked to said object for a certain amount of time.

* * * * *